US008011102B2

(12) United States Patent
Sato et al.

(10) Patent No.: US 8,011,102 B2
(45) Date of Patent: Sep. 6, 2011

(54) DRY SHAVER

(75) Inventors: Masaaki Sato, Hikone (JP); Jyuzaemon Iwasaki, Nagahama (JP); Takeshi Shiba, Hikone (JP); Hiroaki Shimizu, Hikone (JP); Shunsuke Komori, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 61 days.

(21) Appl. No.: 11/952,155

(22) Filed: Dec. 7, 2007

(65) Prior Publication Data

US 2008/0134515 A1 Jun. 12, 2008

(30) Foreign Application Priority Data

Dec. 8, 2006 (JP) ..... 2006-332435

(51) Int. Cl.
*B26B 19/04* (2006.01)

(52) U.S. Cl. ..... 30/43.92; 30/346.51

(58) Field of Classification Search ..... 30/43.9, 30/43.91, 43.92, 77, 81, 346.51, 34.2
See application file for complete search history.

(56) References Cited

U.S. PATENT DOCUMENTS

| | | | | |
|---|---|---|---|---|
| 2,297,915 | A * | 10/1942 | Rand, Jr. et al. | 30/34.2 |
| 2,364,251 | A * | 12/1944 | Testi | 30/65 |
| 3,181,237 | A * | 5/1965 | Jepson et al. | 30/34.2 |
| 3,327,387 | A * | 6/1967 | Harr et al. | 30/34.2 |
| 4,081,902 | A | 4/1978 | Locke | |
| 4,562,644 | A * | 1/1986 | Hitchens | 30/41 |
| 5,185,926 | A | 2/1993 | Locke | |
| 5,398,412 | A * | 3/1995 | Tanahashi et al. | 30/43.92 |
| 5,943,777 | A * | 8/1999 | Hosokawa et al. | 30/34.2 |
| 6,052,904 | A * | 4/2000 | Wetzel et al. | 30/43.92 |
| 6,073,348 | A * | 6/2000 | Shiba | 30/34.1 |
| 6,293,017 | B1 * | 9/2001 | Sato et al. | 30/43.92 |
| 7,237,339 | B2 * | 7/2007 | Parsonage et al. | 30/43.92 |
| 7,730,621 | B2 * | 6/2010 | Komori et al. | 30/346.51 |
| 7,739,798 | B2 * | 6/2010 | Iwasaki et al. | 30/43.92 |
| 2006/0156555 | A1 | 7/2006 | Janny et al. | |
| 2006/0225290 | A1 | 10/2006 | Bader et al. | |

FOREIGN PATENT DOCUMENTS

| | | | |
|---|---|---|---|
| DE | 103 44 566 | A1 | 4/2005 |
| EP | 1 386 559 | A2 * | 2/2004 |
| FR | 1.280.236 | A | 12/1961 |
| FR | 1.435.809 | A | 4/1966 |
| JP | 8-141227 | A | 6/1996 |
| JP | 8-318057 | A | 12/1996 |
| KR | 10-0272416 | B1 | 11/2000 |
| WO | WO-2004/067235 | A1 | 8/2004 |

OTHER PUBLICATIONS

European Search Report for the Application No. EP 07 02 2797 dated Feb. 11, 2008.

(Continued)

*Primary Examiner* — Hwei-Siu C Payer
(74) *Attorney, Agent, or Firm* — Cheng Law Group, PLLC

(57) ABSTRACT

A dry shaver has an elongated shaving head with a lengthwise axis. The shaving head carries semi-cylindrical first and second outer cutters disposed on its opposite width ends, and a semi-cylindrical finishing cutter and a slit cutter interposed between the first and second outer cutters. The finishing cutter has a finishing foil which is deeply curved than a foil of the first and second outer cutters into an arcuate contour having a width less than that of the first and second outer cutters. The finishing foil disposed behind the first outer cutter comes into contact with a users skin to make closer shaving than the first and second cutters. A skin guard project between the first outer cutter and the finishing cutter to protect the skin from being pressed excessively to a side of the finishing foil when moving the shaving head across a user' skin with the first outer cutter leading in a moving direction, thereby reducing skin irritation.

11 Claims, 12 Drawing Sheets

OTHER PUBLICATIONS

Korean Examination Report for the Application No. 10-2007-0126110 from Korean Intellectual Property Office dated Jun. 19, 2009.

The Second Office Action for the Application No. 200710198703X from State Intellectual Property Office of People's Republic of China dated Jan. 29, 2010.

* cited by examiner

DRY SHAVER

TECHNICAL FIELD

The present invention is directed to a dry shaver, more particularly a dry shaver having multiple cutters.

BACKGROUND ART

Japanese Patent publication no. 8-318057 and U.S. Pat. No. 5,185,926 disclose a dry shaver having three elongated semi-circular cutters which are arranged in side-by-side relation with each other. One of the cutters is designed to project to a greater extent than the other cutter to define a finishing cutter which comes first into contact with a user skin for shaving hairs on a narrow area, for example, under a nose and chip top. Although it is found effective to make the intended shaving, the finishing cutter is likely to be pressed excessively at its one side when the shaving head is moving across the skin in a direction perpendicular to the length of the cutter, thereby causing skin irritation or even causing the skin to be cut. This is particularly true, when the finishing cutter is curved more deeply than the other to have an arcuate contour of reduced width. In other words, the deeply curved finishing cutter has an effective cutting zone only around its tip and is not successful to make smooth shaving free from pain at its side zones remote from the tip. Accordingly, when the deeply curved finishing cutter is interposed between the other cutters to project to a greater extent than the others, as seen in U.S. Pat. No. 5,185,926, there is always a risk of pressing the skin excessively at the side of the cutter and irritating the skin.

DISCLOSURE OF THE INVENTION

In view of the above problem, the present invention has been achieved to provide a dry shaver with multiple cutters which is capable of successfully shaving the hairs short on a narrow area without irritating the skin. The dry shaver in accordance with the present invention includes a shaving head which is elongated to have a lengthwise axis and is configured to carry a semi-cylindrical first outer cutter, a semi-cylindrical second outer cutter, and a semi-cylindrical finishing cutter which are all elongated along the lengthwise axis and are arranged in generally parallel relation with each other. Each of the semi-cylindrical first and second outer cutters includes a main foil with a number of perforations and an inner cutter driven by a motor to move in sliding contact with said foil. The main foil is arcuately curved about an axis parallel with the lengthwise axis into an arcuate contour. The semi-cylindrical finishing cutter includes a finishing foil with a number of perforations and an inner cutter driven by the motor to move in sliding contact with the finishing foil. The finishing foil is also arcuately curved about an axis parallel with the lengthwise axis into an arcuate contour having a width less than that of the first and semi-cylindrical second outer cutters. The semi-cylindrical first and second outer cutters are disposed on opposite width ends of the shaving head with the semi-cylindrical finishing cutter being interposed therebetween. The feature of the present invention resides in that the shaving head includes a skin guard which projects between the finishing cutter and one of the first and second outer cutters for contact with a user's skin.

Thus, the skin guard blocks the skin from entering into a recess between the finishing cutter and the adjacent cutter, thereby avoiding the skin from being pressed excessively against the side of the finishing cutter, i.e., an ineffective cutting zone when moving the shaving head across the skin with the first outer cutter leading in the moving direction, and therefore assuring a smooth close shaving without irritating the skin.

Preferably, the skin guard is floatingly supported to a frame of the shaving head and is spring-biased for pressed contact with the user's skin. Thus, the skin guard can be easily to follow the skin while the shaving head is manipulated to move across the skin, minimizing to drag the skin and therefore assuring a comfortable shaving.

The finishing foil may be also floatingly supported to the frame and is spring-biased upwardly for pressed contact with the user's skin. In this instance, the skin guard is coupled to the finishing foil to be movable together therewith to assure an optimum pressing contact of the finishing foil against the skin, while preventing the skin from engaging the side of the finishing foil.

The skin guard may be configured to have a roller or a comb for smooth engagement with the skin or hairs.

In a preferred embodiment, the shaving head additionally carries a slit cutter which is interposed between the finishing cutter and the second outer cutter to define another skin guard which blocks the skin from entering a recess between the finishing cutter and the second outer cutter, also for blocking the skin from contacting the side of the finishing semi-cylindrical cutter. The slit cutter is composed of an elongated outer blade with a number of slits opened at lateral edges of the outer blade, and an inner cutter driven by the motor to move in sliding contact with the outer blade. The outer blade is also supported to the frame, while the finishing foil and the slit cutter are floatingly supported to the frame and are spring biased for pressed contact with the user's skin. With this structure, the slit cutter acting as the skin guard can be depressed together with the finishing cutter and can be therefore kept in optimum contact with the skin, assuring to move the shaving head across the skin smoothly.

In order to place the individual cutters and also the skin guard in smooth contact with the skin, an optimum spatial arrangement are preferred with regard to these elements. That is, the finishing cutter has its top projected by a greater extent than that of said slit cutter, the slit cutter has its top end projected by a greater extent than that of the first outer cutter, and the skin guard between the finishing cutter and the first outer cutter projects to a height between the top end of the first outer cutter and the top end of the finishing cutter, and also at a level lower than the top end of the slit cutter.

Further, the outer blade may be coupled to the finishing foil by means of an adjustor spring so as to be urged from the finishing foil in a direction of being pressed against the user's skin. The adjustor spring generates a counter-spring force acting on the finishing cutter to reduce the spring-bias given per set thereto, thereby realizing the suitably adjusted spring-biases respectively to the finishing cutter and the slit cutter.

Moreover, the finishing foil may be configured to have a region where each of the perforations is surrounded partly by a thin section and partly by a thick section. The thin section gives an increased chance of introducing the hairs deep into the associated perforation for more effective close shaving.

These and still other advantageous features of the present invention will become more apparent from the following detailed description of a preferred embodiment when taken in conjunction with the attached drawings.

BEST MODE FOR CARRYING OUT THE INVENTION

Figure 1:
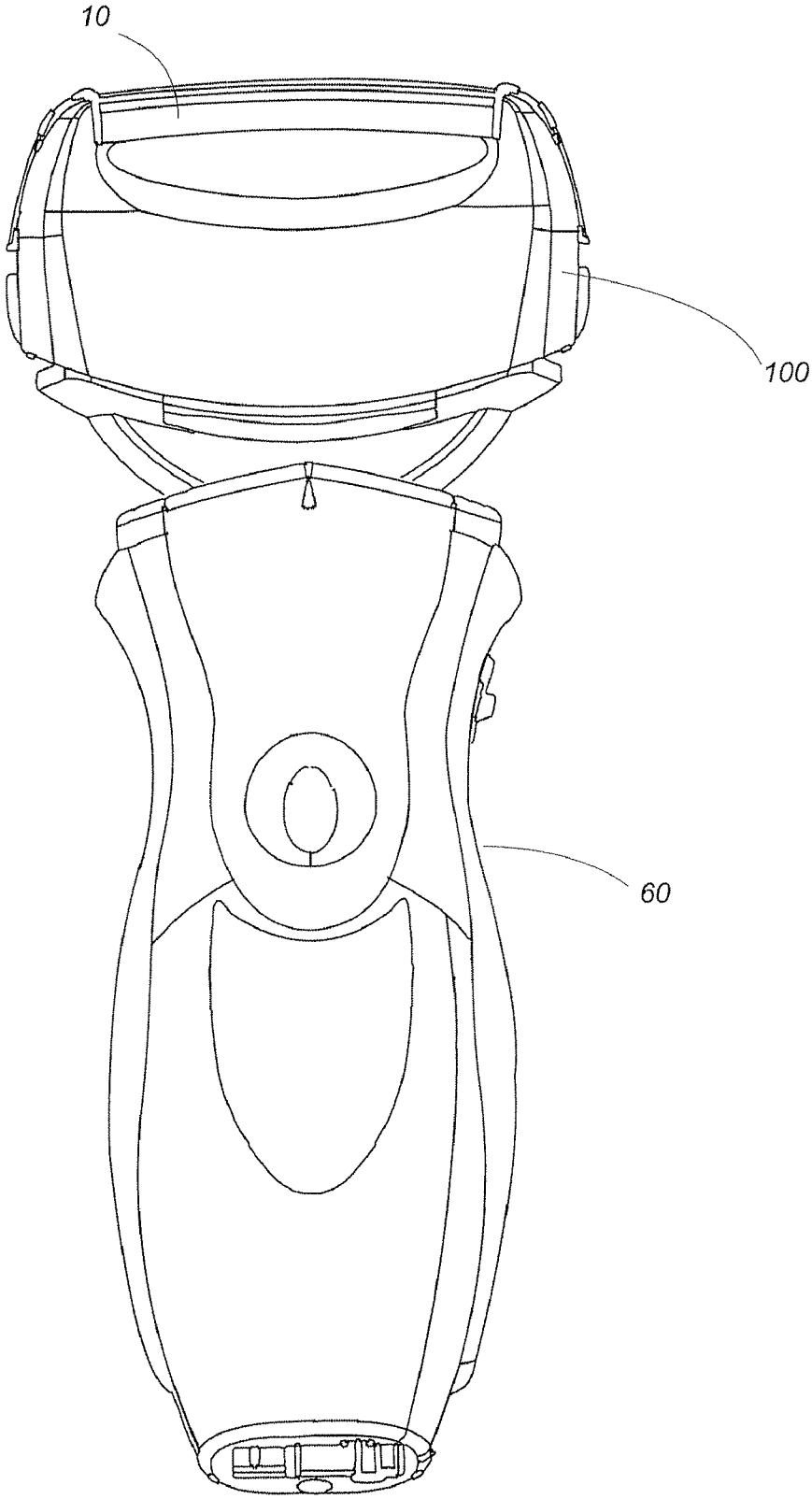
FIG. 1 is a front view of a dry shaver in accordance with a preferred embodiment of the present invention.
Figure 2:
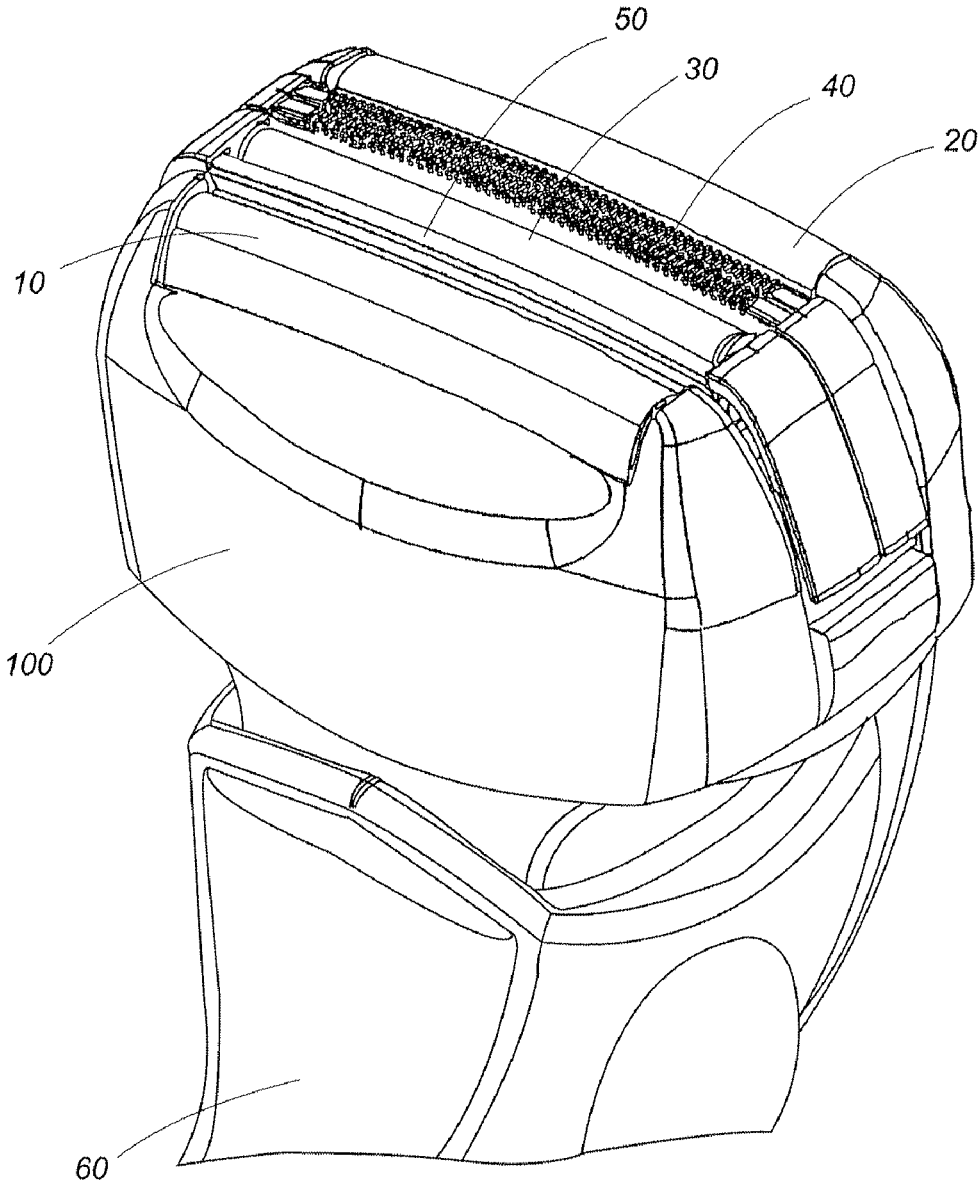
FIG. 2 is a perspective view of a shaving head of the above dry shaver.

Referring now to FIGS. 1 to 5, there is shown a dry shaver in accordance with a preferred embodiment of the present invention. The dry shaver is composed of a hand grip 60 and a shaving head 100 mounted on top of the hand grip 60. The shaving head 100, which is elongated to have a lengthwise axis and a width axis, is connected to the grip 60 to be movable relative thereto about an axis perpendicular to the lengthwise axis. The shaving head 100 carries four differently configured cutters, namely, a semi-cylindrical first outer cutter 10, a semi-cylindrical second outer cutter 20, a semi-cylindrical finishing cutter 30, and a slit cutter 40. These cutters are all elongated along the lengthwise axis of the shaving head 100 and arranged in parallel relation with each other along the width axis.

Figure 5:
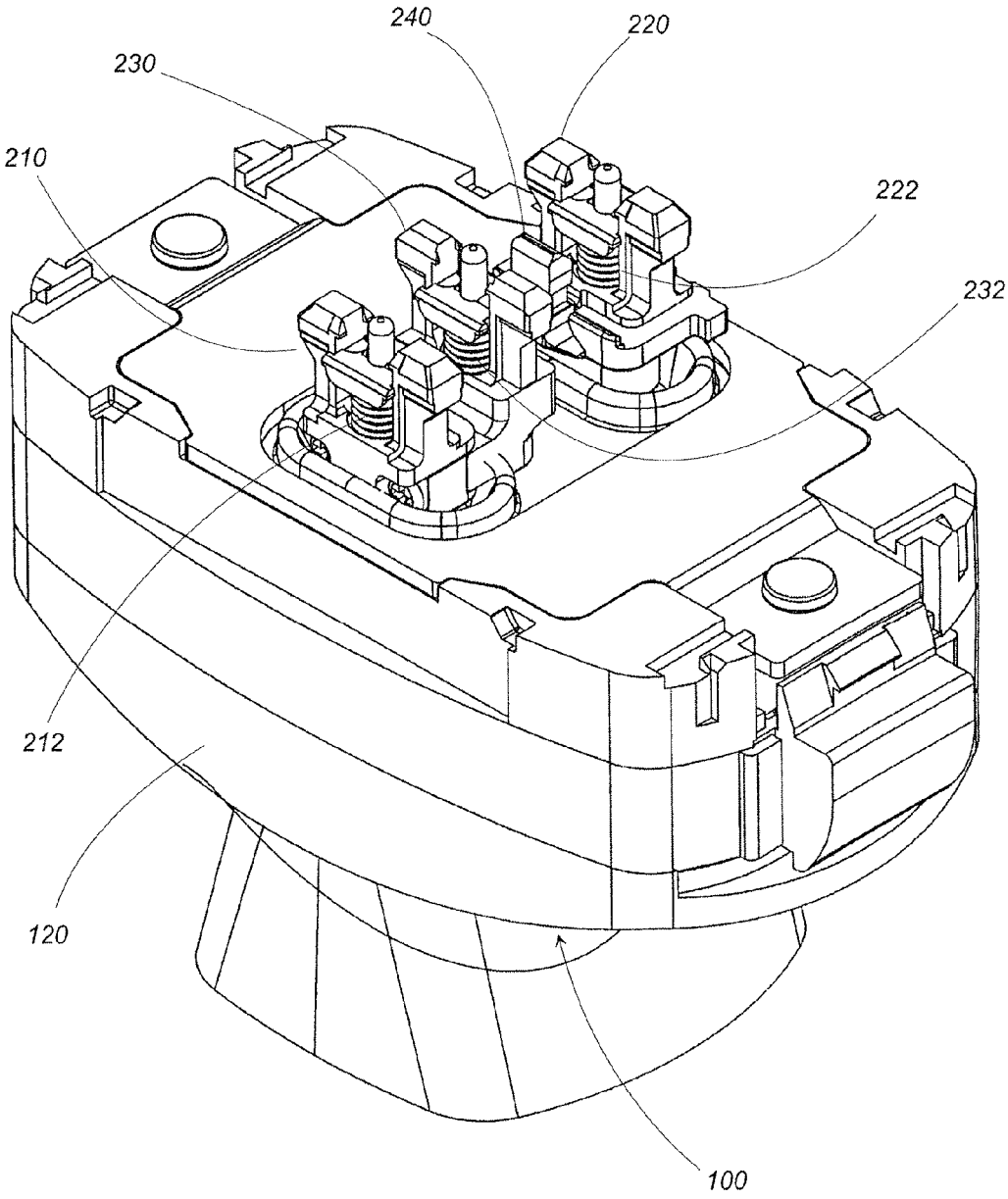
FIG. 5 is a portion of the above shaving head.

The shaving head 100 is composed of a casing 120 and a frame 130 detachable to the casing 120. The casing 120 is of a water-proof structure accommodating therein a linear motor 150 and is provided with a plurality of driving elements 210, 220, 230, and 240 projecting on top of the casing 120, as shown in FIG. 5. These driving elements are connected to the linear motor 150 to be driven thereby to reciprocate along the lengthwise axis of the shaving head 100. The first and second outer cutters 10 and 20 are disposed on the opposite width ends of the shaving head 100, with the finishing cutter 30 and the slit cutter 40 interposed therebetween. The grip 60 is provided with a trimmer 80 on its rear width end further away from the first cutter 10 than from the second cutter 20.

Figure 4:
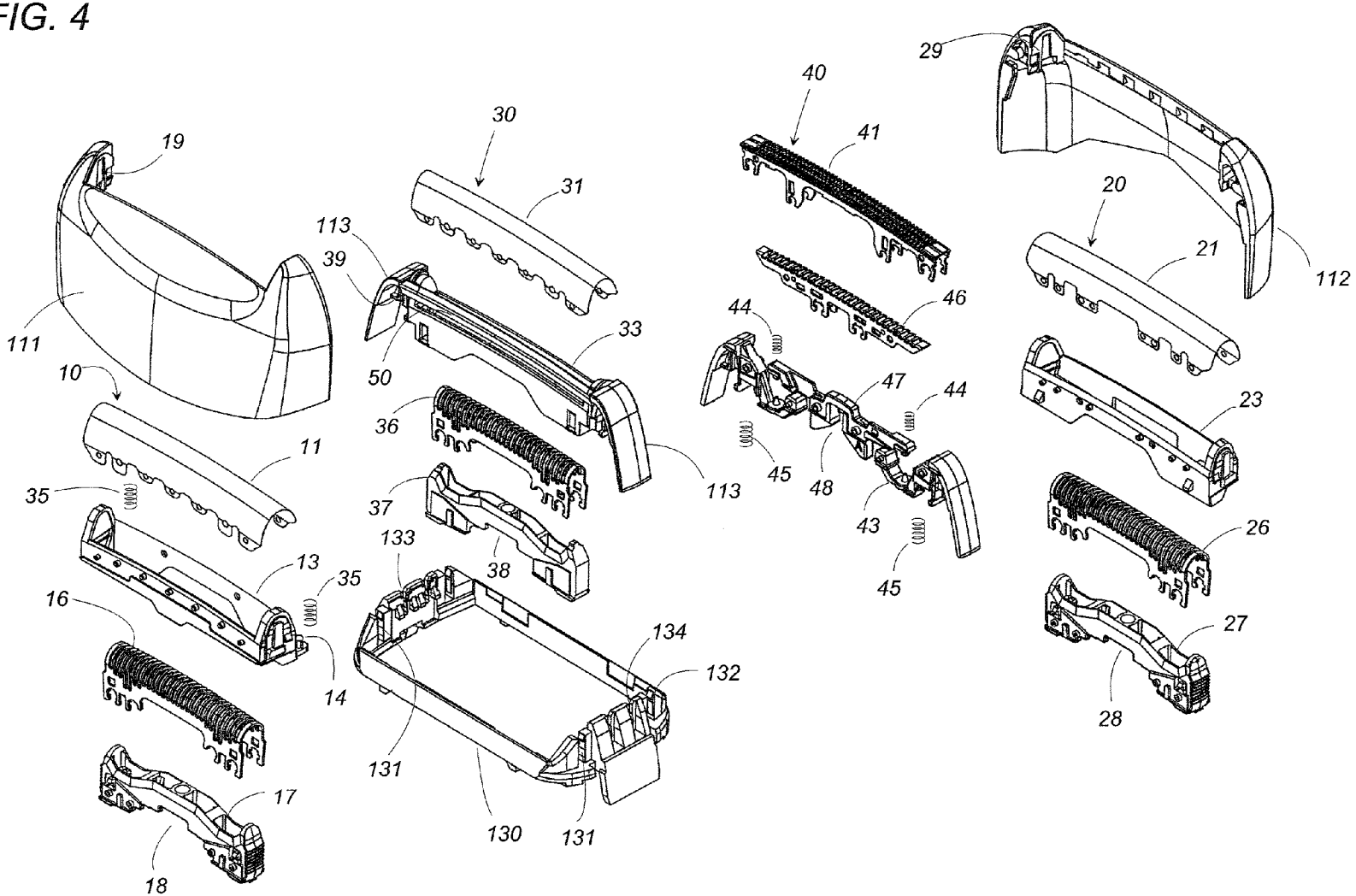
FIG. 4 is an exploded perspective view of the above shaving head.

The first and second outer cutters 10 and 20 are each composed of a main foil 11 and 21, and an inner cutter 16 and 26 which are driven by the linear motor 150 to reciprocate in hair shearing engagement with the main foil. The main foil is formed with a plurality of perforations, and is arcuately curved about an axis parallel to the lengthwise axis of the shaving head 100 into an arcuate contour, i.e., semi-cylindrical shape having a width with respect to the with axis of the shaving head. The first and second outer cutters 10 and 20 are configured to have the main cutters of identical configurations, i.e., the same width and the same radius of curvature, as well as the inner cutters of identical configurations. As best shown in FIG. 4, the main foil 11 (21) is secured at its opposite lateral ends to a mount 13 (23), while the associated inner cutter 16 (26) is secured to a base 17 (27). The mount 13 (23) is floatingly supported to the frame 130 to be movable relative to the frame, and therefore to the casing 120. The bases 17 and 27 are formed in their bottom respectively with catches 18 and 28 which detachably receive the driving elements 210 and 220 for reciprocating the inner cutters 16 and 26. Each of the driving elements 210 and 220 carries a biasing spring 212 and 222 which gives a spring bias SB212 (SB2222) urging the inner cutter and the associated main foil upwardly such that the first and second outer cutter 10 and 20 are capable of being depressed upon being pressed against a user's skin. The mounts 13 and 23 are secured respectively to a front cover 111 and a rear cover 112 which constitute a front wall and a rear wall of the shaving head 100. The front cover 111 is provided at its lengthwise ends with studs 19 which are slidably engaged into corresponding vertical grooves 131 in the frame 130. Likewise, the rear cover 112 is provided at its lengthwise ends with studs 29 which are slidably engaged into corresponding vertical grooves 132 in the frame 130.

Figure 3:
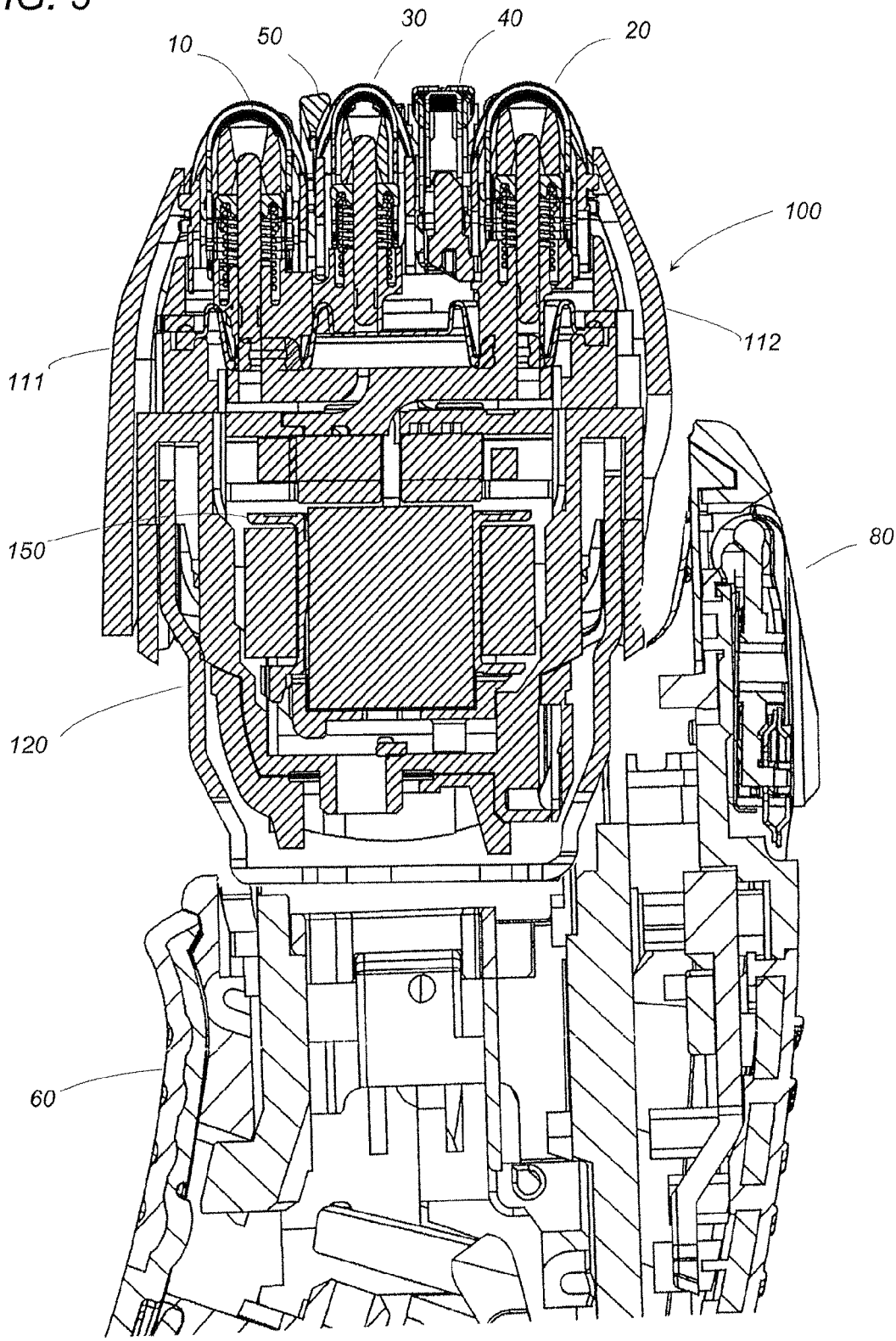
FIG. 3 is a sectional view of the above shaving head.
Figure 6:
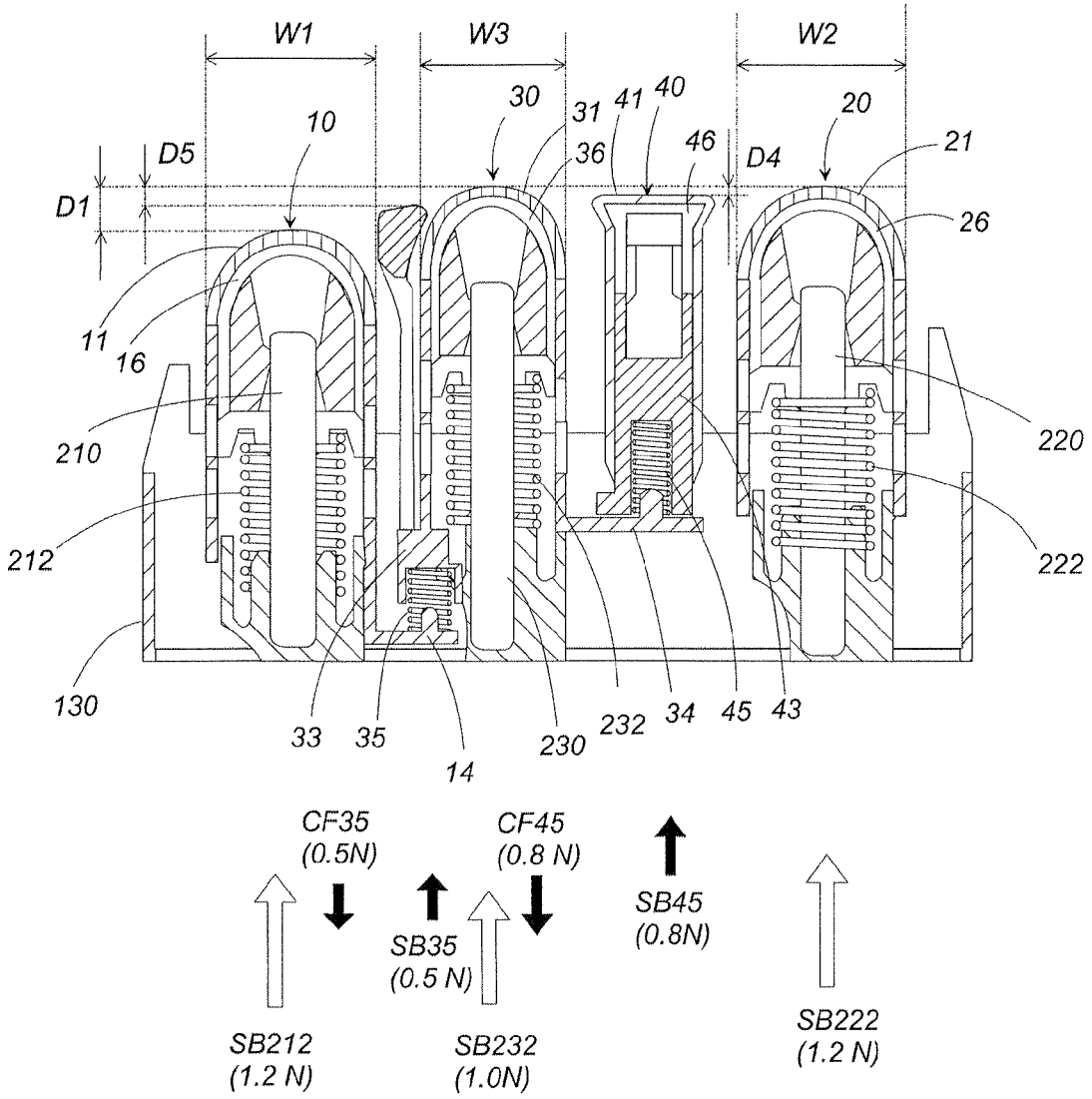
FIG. 6 is a diagram illustrating relationship between four cutters carried on the above shaving head.

The finishing cutter 30 is introduced in the shaving head 110 in order to make making a closer shaving than the first and second cutters 10 and 20, and is composed of a finishing foil 31 and an inner cutter 36 detachably connected to the reciprocating driving element 230 to be driven thereby to reciprocate in hair shearing engagement with the finishing foil 31. The finishing foil 31 is formed with a plurality of perforations 32 and is arcuately curved about an axis parallel to the lengthwise axis of the shaving head 100 into an arcuate contour, i.e., semi-cylindrical shape having a width along the width axis of the shaving head. As best shown in FIGS. 3 and 6, the finishing foil 31 is deeply curved to have a radius of curvature smaller than that of the main foils 11 and 21, and therefore the width W3 smaller than those W1 and W2 of the main foils, thereby increasing a chance of capturing hairs deep into the perforations, particularly around a tip of the finishing foil 31 for cutting the hairs shorter than expected at the first and second cutters 10 and 20, i.e., finishing the hairs to minimum length. As shown in FIG. 4, the finishing foil 31 is secured at its opposite lateral ends to a mount 33, while the inner cutter 36 is fixed to a base 37. The base 37 is formed in its bottom with a catch 38 which detachably receives the driving element 230 for reciprocating the inner cutter 36. The mount 33 is floatingly supported to the frame 130 so as to be movable relative to the casing 120 of the shaving head 100. The mount 33 is formed integrally with a skin guard 50 which projects between the first cuter cutter 10 and the finishing cutter 30 and is movable together with the finishing foil 31 relative to the casing 120. The skin guard 50 extends in parallel and in closely adjacent relation to the side of the finishing foil 31. The mount 33 is formed at its opposite lengthwise ends with side covers 113 which constitute portion of side walls of the shaving head 100. The driving element 230 carries a spring 232 which gives a spring bias SB232 urging the inner cutter against the finishing foil 31 and therefore the finishing cutter 31 upwardly such that the finishing cutter 31 is capable of being depressed upon being pressed against with the user's skin. The mount 33 is also formed at its opposite lengthwise ends with studs 39 which are held slidable in corresponding grooves 133 in the frame 130 so that the finishing cutter 30 is movable relative to the frame 130 as being biased upwardly by the spring 232.

The slit cutter 40 is composed of an elongated outer blade 41 with a number of slits opened at lateral edges of the outer blade 41, and an inner cutter 46 driven to reciprocate in hair shearing engagement with the outer blade 41. The outer blade 41 is shaped to have a generally flat top surface for sliding contact with the user's skin to capture flattened hairs into the slits for cutting the hairs. The outer blade 41 is fixed to a mount 43 which is floatingly supported to the frame 130. The inner cutter 46 is secured to a base 47 which is slidably held on the mount 43 to reciprocate the inner cutter 46 relative to the outer blade 41. Springs 44 are interposed between the mount 43 and the base 47 to keep the inner cutter 46 pressed against the outer blade 41. The frame 43 is formed at its opposite lengthwise ends with studs 49 which are slidably engaged into corresponding grooves 134 in the frame 130 for floatingly support the slit cutter 40 to the frame 130. The base 47 is formed in its bottom with a catch 48 which detachably receives the driving element 240 for reciprocating the inner cutter 46. As shown in FIG. 5, the driving element 240 is integrally formed with the driving element 220 but gives no bias to the slit cutter 40. Instead, springs 45 are interposed between the frame 43 and extensions 34 extending from the mount 33 of the finishing cutter 30 to give a sprig bias SB45 urging the slit cutter 40 upwardly.

Figure 7:
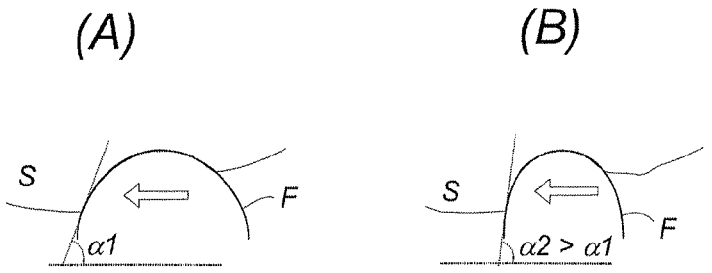
FIG. 7 is a schematic view illustrating a manner in which a moving arcuate foil contacts with a skin.
Figure 8:
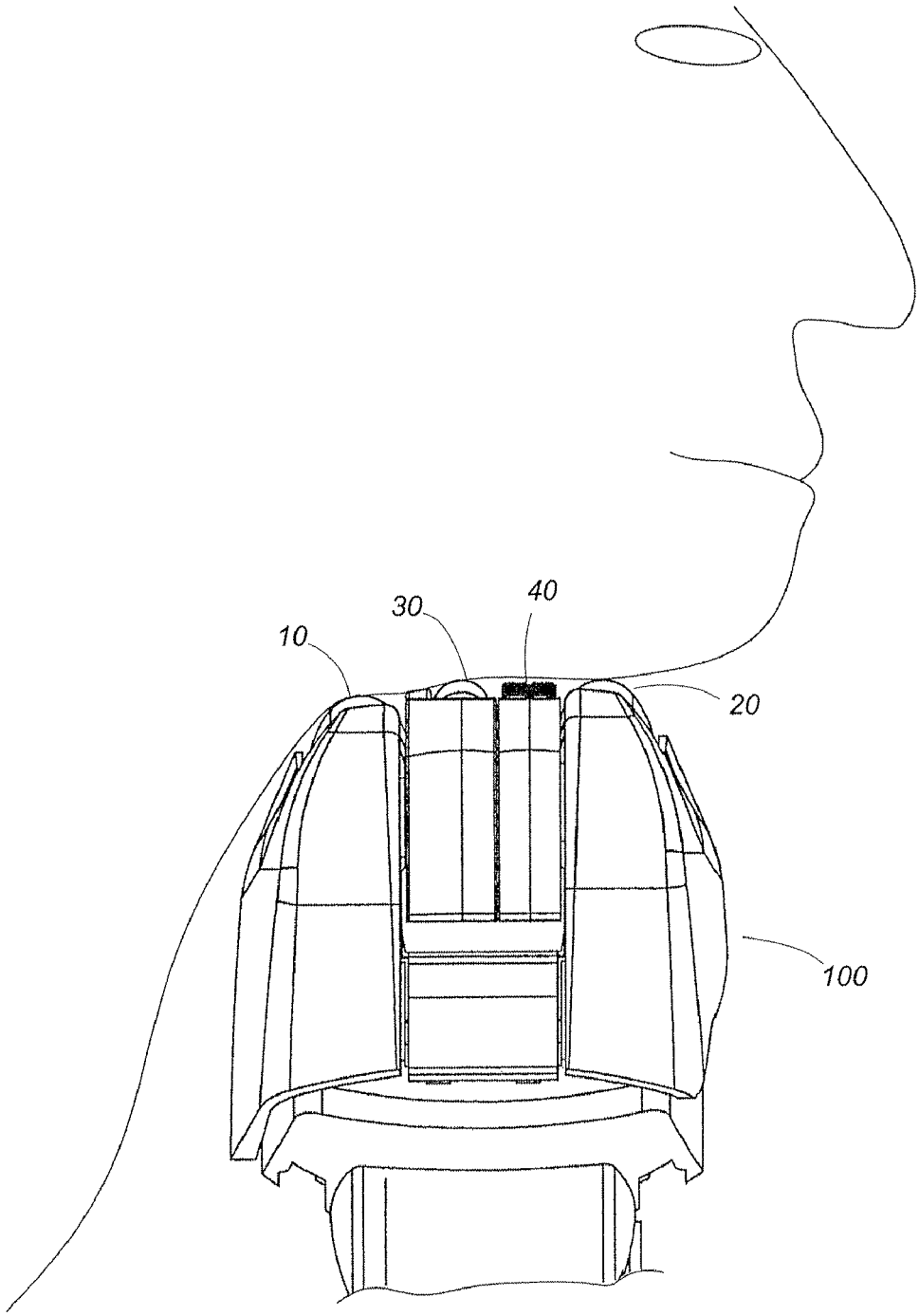
FIGS. 8 and 9 are schematic view illustrating operations of the above shaver.
Figure 9:
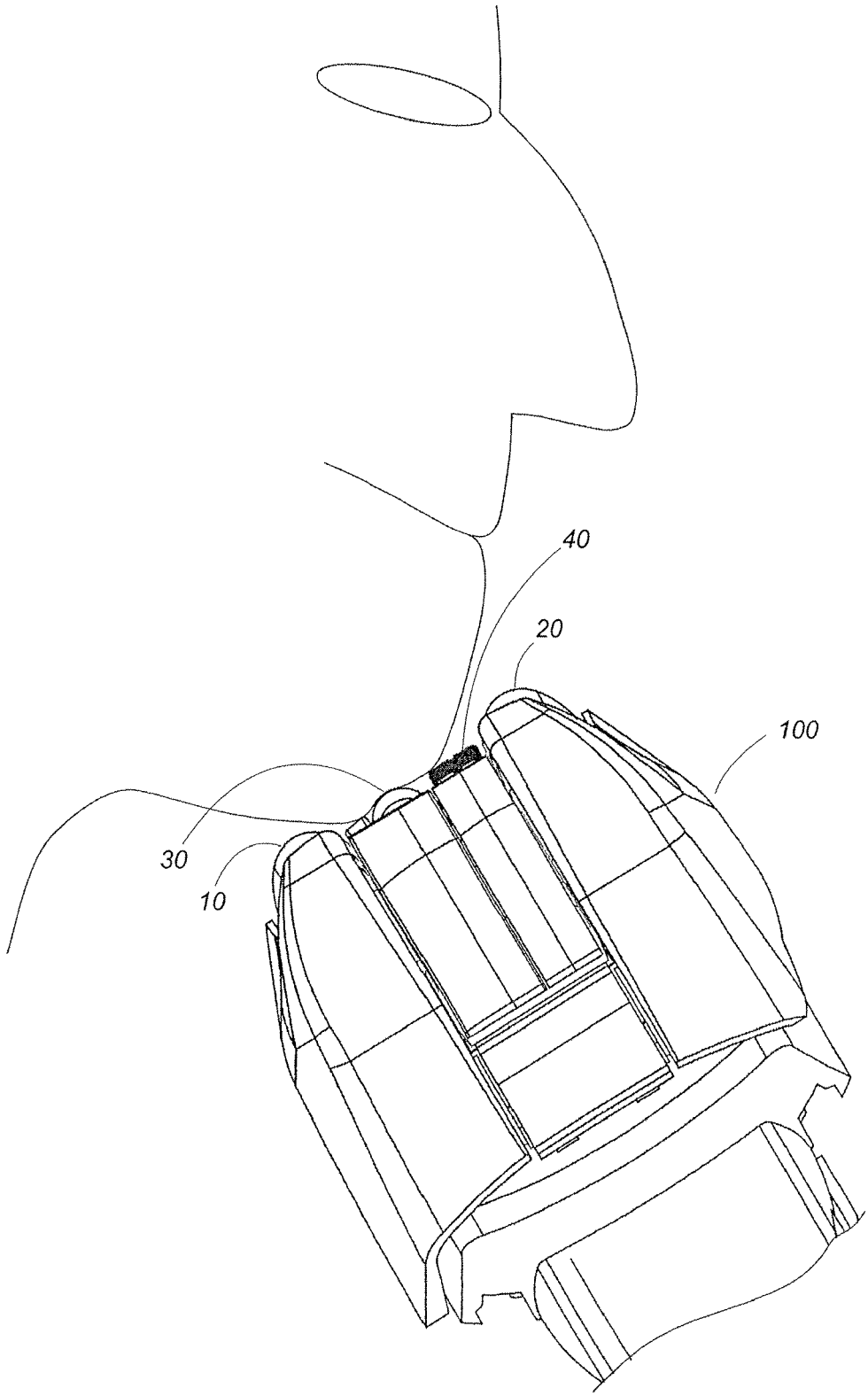

FIG. 6 shows a height relationship among the four cutters in a free condition of not being depressed or not being held in pressed contact with the user's skin. The second cutter 20 and the finishing cutter 30 are disposed to have their tips at the same level, while the first cutter 10 has its tip lowered by a large difference D1 from that of the finishing cutter 30, and the slit cutter 40 has its tip lowered by a small difference D4 from that of the finishing cutter 30. The skin guard 50 which is movable together with the finishing cutter 30 has its tip disposed at a level higher that that of the first cutter 10 but is lower than that of the finishing cutter 30 by a difference of D5. With this multi-cutter arrangement, each cutter can be held in an optimum contact with the user's skin for effective shaving. For example, when shaving hairs under the chin, as shown in FIG. 8, with the first cutter 10 ahead in the moving direction, the cutters are simultaneously held in contact with the skin to make the individual shaving effectively. On the other hand, when shaving a narrow area such as a chin top, as shown in FIG. 9, the finishing cutter 30 can be pressed against the skin in combination with the skin guard 50 and the slit cutter 40 so as to cut the hairs to minimum. In this connection, it is noted that as a result of being deeply curved, the finishing foil 31 is given an effective cutting zone only around its tip and leave ineffective zones respectively on its opposite sides where the skin is likely to cause skin irritation when being pressed hard against the skin. That is, as shown in FIGS. 7(A) and (B), as the foil F is curved deeper, the foil is caused to be pressed against at a greater angle ($\alpha 1$, $\alpha 2$) of contact on its leading side with respect to a direction of moving the shaving head, and is therefore pressed at a greater force against the skin S, which eventually increases a chance of capturing the skin deep through the perforations in the foil, and accordingly irritating the skin. In this sense, the lower portion on the side of the deeply curved finishing cutter 30 is not suitable for pleasant shaving in a situation when the shaving head is moving around the skin with the finishing cutter being pressed at its leading side against the skin, while the upper portion of the side of the finishing cutter is effectively utilized for cutting the hairs minimum.

In order to avoid the skin from contacting the lower portion of the side of the finishing cutter, i.e., ineffective zone, the skin guard 50 is positioned to cover ineffective zone in closely adjacent relation thereto with its top slightly lowered from the tip of the finishing cutter 30, for the purpose of exposing the effective zone, i.e., the upper portion of the finishing cutter 30 around its tip for close shaving. In this connection, the skin guard 50 is offset towards the finishing cutter 30 so as not to interfere with the shaving operation of the first outer cutter 10. The slit cutter 40 also act as another skin guard in a sense of avoiding the skin from contacting with the lower side portion of the finishing cutter 30 and minimizing the skin irritation, when the shaving head 100 is moving with the second outer cutter 20 leading in the direction of movement.

Turning back to FIG. 6, the finishing foil 31 is urged upwardly also by adjustor springs 35 interposed between the frame 33 of the finishing foil 31 and projections 14 extending from the frame 13 of the first outer cutter 10 such that the finishing foil 31 receives an upward spring-bias which is a combination of the upward spring bias SB232 from the spring 232 of the driving element 230, and an upward additional spring bias SB35 by the adjustor spring 35, and the downward spring bias CF45, which is a counter-force of the springs 45 urging the slit cutter 40 upwardly. The adjustor springs 35 develop a counter-force CF35 which urges the main foil 11 of the first outer cutter 10 downwards such that the first outer cutter 10 receives an upward spring bias, a combination of the upward spring bias SB212 from the spring 212 of the driving element 210 and the downward bias CF35 of the adjustor springs 35. Thus, as schematically illustrated by corresponding arrows in FIG. 6, the individual cutters are given optimum spring bias by use of the adjustor springs 35 and 45. Particularly, the first outer cutter 10 and the second outer cutter 20 can be given different spring biases, while using the driving elements 210 and 220 of the same configuration, i.e., the springs 212 and 222 of the same spring forces. For example, when the driving elements 210, 230, and 220 are selected to have spring biases SB212, SB232, and SB222 respectively of 1.2 N, 1.0 N, and 1.2 N, in combination with the adjustor springs 35 having the spring force of 0.5 N, and the springs 45 having the spring force of 0.8N, the first outer cutter 10, the finishing cutter 30, the slit cutter 40, and the second outer cutter 20 are given the spring biases of 0.7 N (=1.2 N−0.5 N), 0.7 N (=1.0 N+0.5 N−0.8 N), 0.8 N, and 1.2 N, respectively.

Figure 10:
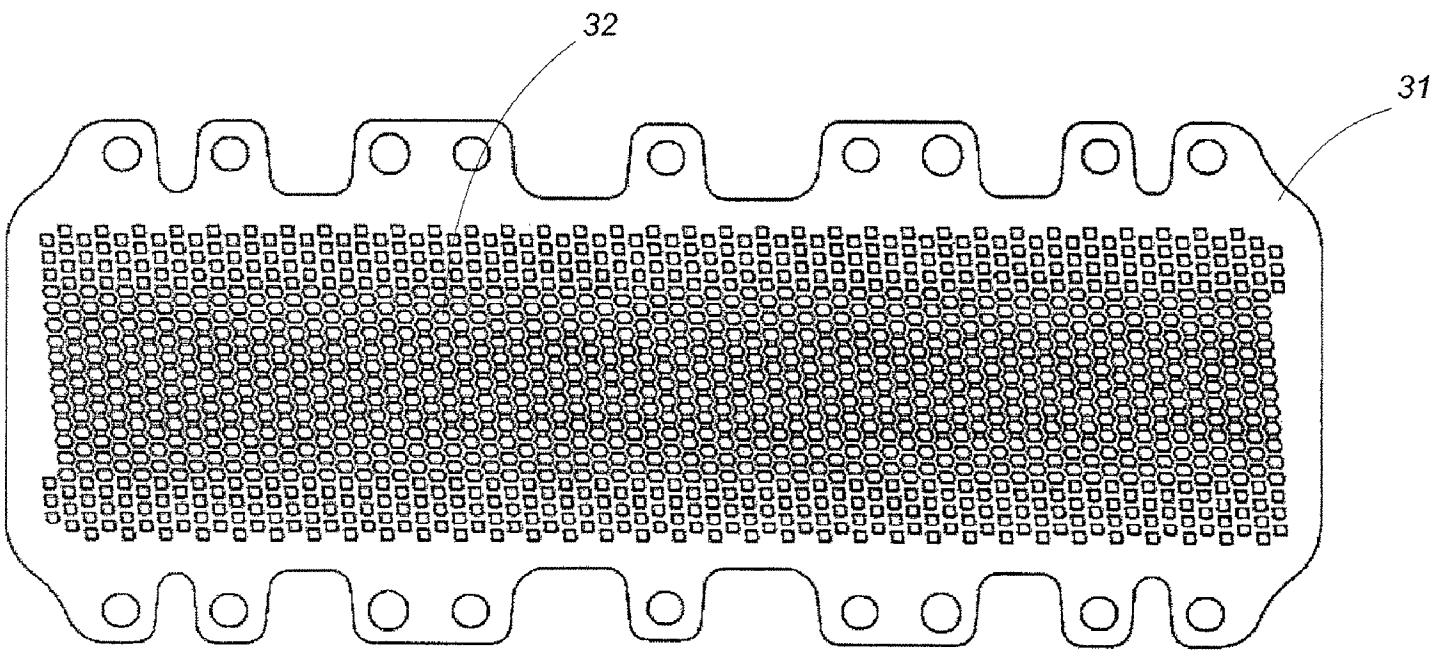
FIG. 10 is a plan view of a finishing foil forming a finishing cutter, one of the above four cutters.
Figure 11:
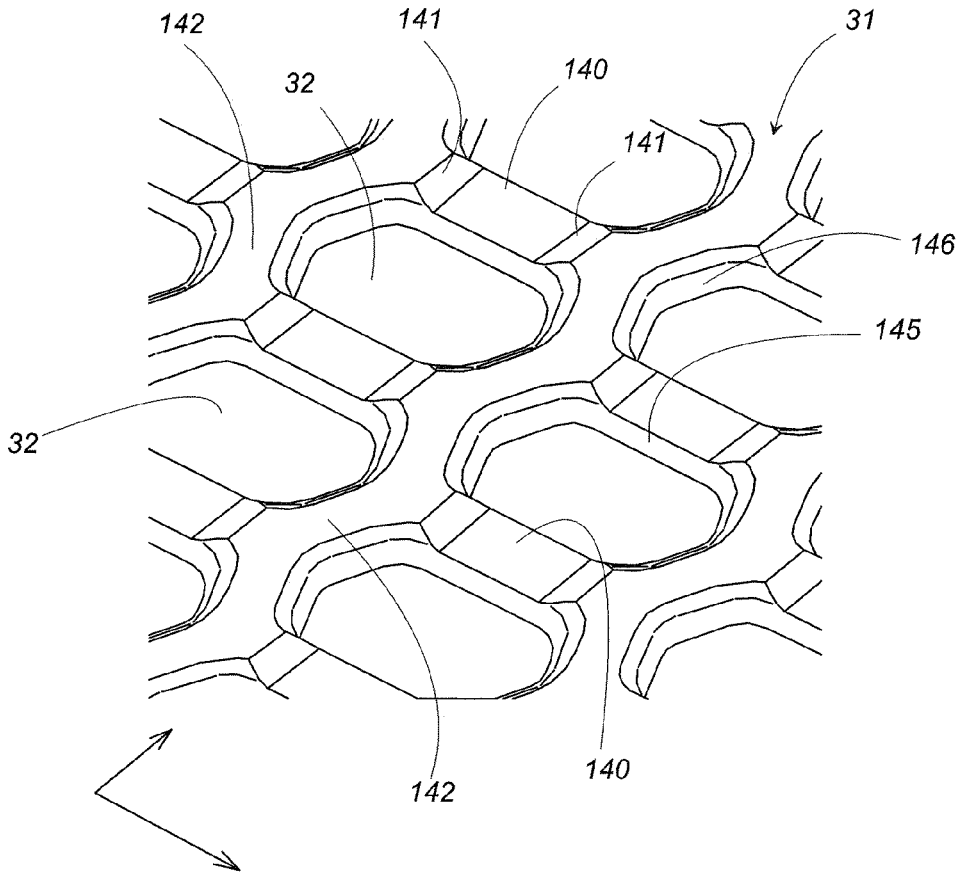
FIG. 11 is a perspective view of the above finishing foil.

Referring to FIGS. 10 and 11, the finishing foil 31 are now explained in details with respect to its structural feature. The perforations 32 are arranged in an array composed of rows aligned with a length of the foil and columns aligned along a direction slightly inclined with respect to a width direction of the foil. As shown in FIG. 11, the foil 31 is formed in its top surface with a plurality of recesses 140 arranged along each column in an alternating relation with the perforations 32 to define plural series of thin sections 140 of reduced thickness, leaving the other portions as thick sections 142 which continuously extends over the full width of the foil 31 between the adjacent columns of the perforations 32. With this result, each of the perforations 32 has its circumference partly defined by the thin sections 140 and partly by the thick sections 142. Since the thin sections 140 alternate with the perforations 32 along the column, the hairs are guided along a series of the thin sections 140 as the shaving head 100 is moved across the skin with the cutter being oriented to have its width in generally perpendicular to the moving direction, during which the flattened hairs can be easily guided into the perforations through the thin sections and are raised at the edge of the perforation 32 adjacent the thin section 140 for successfully cutting the flattened hairs. On the other hand, the thick sections 142 provide flat faces which extend continuously along the columns, or the width direction of the foil 31 to give a smooth skin contact for facilitating the shaving, while retaining the effect of raising and cutting the flattened hairs by provision of the thin sections 140. For instance, the thick section is selected to have a thickness of 50 μm to 80 μm, while the thin section 140 has a thickness of 45 μm or less. In this connection, the main foils 11 and 21 are each formed from a foil of uniform thickness which is greater than that of the thin section 140 and is equal to or greater than that of the thick section 142.

As shown in FIG. 11, each of the perforations 32 are shaped into a hexagon having an opposed pair of long sides and two opposed pairs of short sides. The thin sections 140 merge into the long sides, while the thick sections 142 merges into the short sides. That is, each perforation 32 is surrounded at its long sides by the thin sections 140 and at its short sides surrounded by the thick sections 142. The thin section 140 has its top surface connected to the top surface of the thick sections 142 by way of inclined shoulders 141. The hexagon is dimensioned, for example, to have a length of 0.5 mm in the row direction, and a width of 0.3 mm in the column direction.

Figure 12:
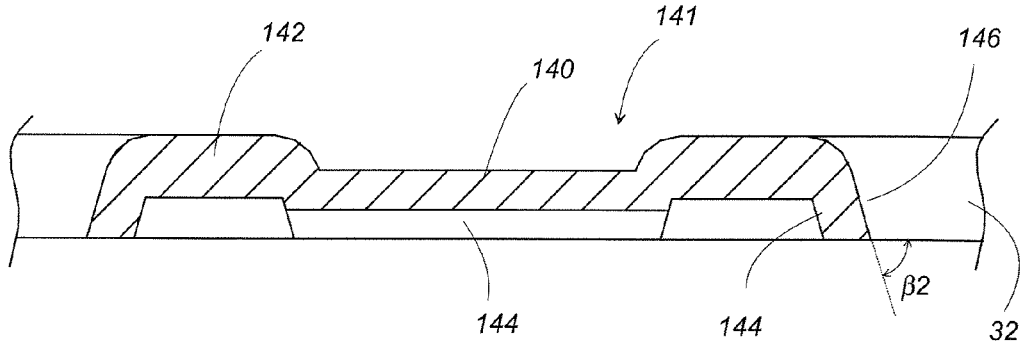
FIG. 12 is a cross-section of a part of the above finishing foil along one direction.
Figure 13:
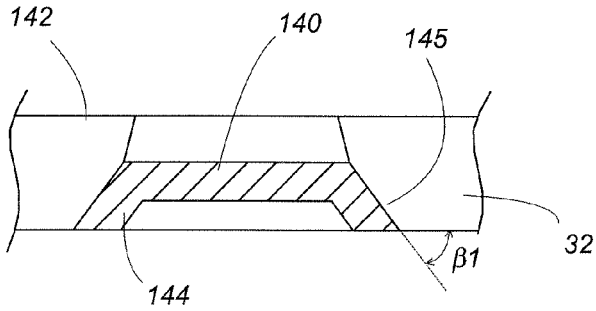
FIG. 13 is a cross-section of a part of the above finishing foil along another direction.

As shown in FIGS. 12 and 13, each perforation 32 is surrounded by a raised rim 144 which projects on bottom of the foil 31, and is shaped to have inclined edges 145 and 146, respectively leading from the long sides and short sides. The inclined edge 145 extends continuously from the thin section 140 is given at its lower end a cutting angle of $\beta 1$ smaller than the cutting angle of $\beta 2$ at the lower end of the inclined edge 146. The smaller cutting angle of $\beta 1$ is found advantageous to enhance the effect of raising the flattened hairs guided by the thin sections 140. Further, the finishing foil 31 is configured to include the thick sections 142 which occupy a larger area than the thin section 140, in order to give sufficient mechanical strength and assure the smooth skin contact.

Although the above embodiment illustrates that the finishing foil 31 includes the thin sections and the thick sections, it may be equally possible that the finishing foil 31 is devoid of the thick sections to have a uniform thickness which is less than that of the main foil. Further, the main foils 11 and 21 of the first outer cutter 10 and the second outer cutter 20 may be selected to have the like configuration including the thin sections and the thick section, provided that the finishing foil 31 has its width less than that of the main foil. The present invention therefore encompass a structure in which the finishing foil 31 is shaped to have its width smaller than that of the main foil, and/or the finishing foil 31 includes the thin section around each perforation where the thin section has a thickness less than that of the main foil.

Figure 14:
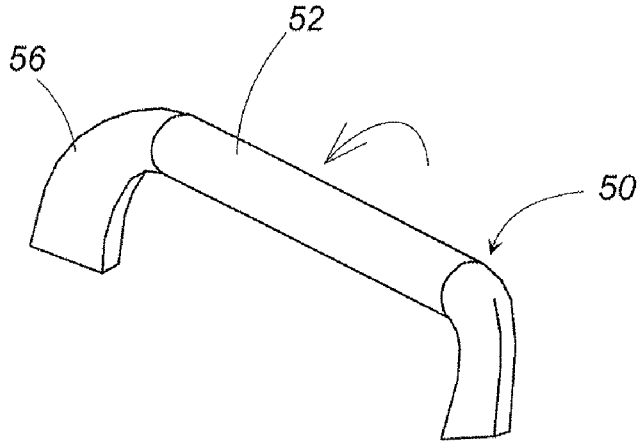
FIG. 14 is a perspective view illustrating a modification of the skin guard.
Figure 15:
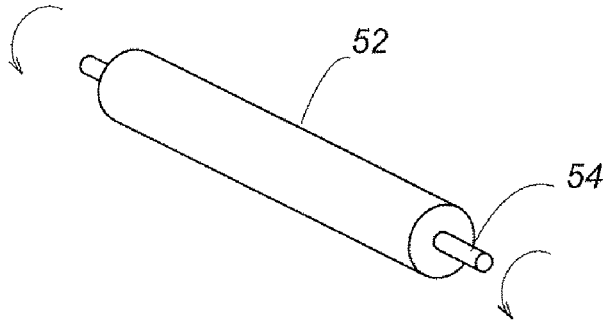
FIG. 15 is a perspective view of a roller utilized in the above skin guard.

Further, as shown in FIGS. 14 and 15, the above skin guard 50 may be modified to include a roller 52 for rolling contact with the user's skin. The roller 52 is configured to have axles 54 which project on opposite ends of the roller 52 and are rotatably supported to brackets 56 fixed to the mount carrying the finishing foil 31.

Figure 16:
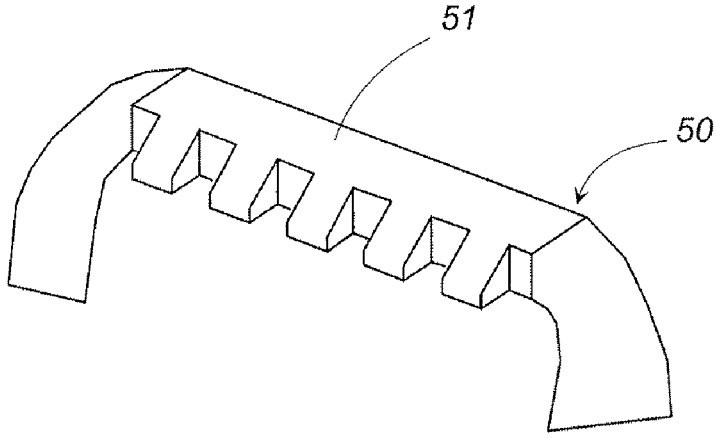
FIG. 16 is a perspective view of another modification of the skin guard.

Alternatively, the skin guard 50 may be shaped to have a comb 51 with a number of teeth, as shown in FIG. 16, for smoothening the hairs prior to introducing the hairs to the finishing cutter 30.

In the illustrated embodiment, each of the cutters 10, 20, 30, and 40 as well as the skin guard 50 are slightly curved arcuately with respect to the lengthwise axis for smooth contact with the skin. However, the present invention should not be interpreted to be limited thereto and may equally encompass the arrangement in which at least one of the cutters and the skin guard is configured to have straight top surface with respect to the lengthwise direction.

The invention claimed is:

1. A dry shaver comprising:

a shaving head which is elongated to have a lengthwise axis and a width axis, said shaving head being configured to carry a semi-cylindrical first outer cutter, a semi-cylindrical finishing cutter, and a semi-cylindrical second outer cutter which are all elongated along said lengthwise axis and are arranged in generally parallel relation with each other, each of said first and second outer cutters comprising a main foil with a number of perforations and an inner cutter driven by a motor to move in sliding contact with said foil, said main foil being curved about an axis parallel with said lengthwise axis into an arcuate contour;

said finishing cutter comprising a finishing foil with a number of perforations and an inner cutter driven by said motor to move in sliding contact with said finishing foil, said finishing foil being curved about an axis parallel with said lengthwise axis into an arcuate contour having a less width than that of said main foil, said first and second outer cutters being disposed on opposite width ends of said shaving head with said finishing cutter being interposed therebetween, wherein said shaving head includes a first skin guard projecting between said finishing cutter and said first outer cutter for contact with a skin of a user, wherein said shaving head carries a slit cutter interposed between said finishing cutter and said second outer cutter to define a second skin guard which blocks the skin from entering a recess between said finishing cutter and said second outer cutter, said slit cutter comprising an elongated outer blade with a number of slits opened at lateral edges of said outer blade, and an inner cutter driven by said motor to move in sliding contact with said outer blade.

2. A dry shaver as set forth in claim 1, wherein said shaving head includes a frame configured to support said main foils, said finishing foil, and said outer blade.

3. A dry shaver as set forth in claim 2, wherein said finishing foil and said slit cutter are floatingly supported to said frame and is spring biased for pressed contact with the user's skin.

4. A dry shaver as set forth in claim 3, wherein said finishing foil is spring-biased upwardly for pressed contact with the user's skin, said first skin guard being coupled to said finishing foil to be movable together therewith.

5. A dry shaver as set forth in claim 3, wherein said first skin guard is configured to have a roller for rolling contact with the user's skin.

6. A dry shaver as set forth in claim 3, wherein said first skin guard is configured to have a comb.

7. A dry shaver as set forth in claim 3, wherein said finishing cutter has its top projected by a greater extent than that of said slit cutter, said slit cutter has its top end projected by a greater extent than that of the first outer cutter, and said first skin guard between the finishing cutter and said first outer cutter projects to a height between the top end of said first outer cutter and the top end of said finishing cutter, and also at a level lower than the top end of said slit cutter.

8. A dry shaver as set forth in claim 3, wherein said outer blade of the slit cutter is floatingly supported to said frame and is coupled to said finishing foil by means of an adjustor spring so as to be urged from said finishing foil in a direction of being pressed against the user's skin.

9. A dry shaver as set forth in claim 3, wherein said finishing foil is configured to have the perforations each surrounded partly by a thin section and partly by a thick section, said thin section defined by a recess formed in a top skin contacting surface of said finishing foil.

10. A dry shaver as set forth in claim 3, wherein said first skin guard is floatingly supported to said frame and is spring-biased for pressed contact with the user's skin.

11. A dry shaver as set forth in claim 1, wherein said first skin guard is offset towards the finishing cutter so as not to interfere with the shaving operation of the first outer cutter.

* * * * *